US005288115A

United States Patent [19]

Inoue et al.

[11] Patent Number: 5,288,115

[45] Date of Patent: Feb. 22, 1994

[54] AUTO-CLOSING VEHICLE DOOR LOCK DEVICE

[75] Inventors: Jiro Inoue; Jiro Mitsui; Patrik J. Dowling, all of Yamanashi, Japan

[73] Assignee: Mitsui Kinzoku Kogyo Kabushiki Kaisha, Tokyo, Japan

[21] Appl. No.: 986,396

[22] Filed: Dec. 7, 1992

[30] Foreign Application Priority Data

| | | | |
|---|---|---|---|
| Dec. 6, 1991 | [JP] | Japan | 3-348973 |
| Dec. 11, 1991 | [JP] | Japan | 3-350925 |
| Dec. 19, 1991 | [JP] | Japan | 3-354615 |
| Dec. 26, 1991 | [JP] | Japan | 3-357653 |

[51] Int. Cl.[5] ..... E05C 3/26

[52] U.S. Cl. ..... 292/201; 292/216

[58] Field of Search ..... 292/DIG. 14, DIG. 43, 292/201, 216, DIG. 72, 280

[56] References Cited

U.S. PATENT DOCUMENTS

| | | | |
|---|---|---|---|
| 4,735,447 | 4/1988 | Kleefeldt | 292/216 |
| 4,906,035 | 3/1990 | Nagai et al. | 292/201 |
| 4,948,183 | 8/1990 | Yamada | 292/199 |
| 4,988,135 | 1/1991 | Ottino | 292/201 |
| 5,180,198 | 1/1993 | Nakamura et al. | 292/201 |

*Primary Examiner*—Richard E. Moore

*Attorney, Agent, or Firm*—Browdy and Neimark

[57] ABSTRACT

A vehicle door lock assembly having a housing to be secured to a vehicular door structure. The housing has a dent extending along an about up-and-down direction, a striker secured to the vehicular body, a latch rotating from its open position to its fully locked position through its half-latched position, a ratchet preventing the latch from reverse-rotating, a motor functioning when the latch rotates to the half-latched condition, and a lever driven by a motor in order to engage with the latch positioned at the half-latched position so as to rotate the latch to its fully latched position. The lever, latch and ratchet are operative arranged in the dent of the housing along an up-and-down direction and secured to the housing wall by three parallel shafts.

13 Claims, 8 Drawing Sheets

AUTO-CLOSING VEHICLE DOOR LOCK DEVICE

BACKGROUND OF THE INVENTION

1. Field of the Invention

The present invention relates to an auto-closing vehicle door lock device, in particular to a door lock device for completely closing and compulsorily locking, for example, a side door of a motor vehicle after the door is closed halfway by hand by a power of a motor or the like functioning after the halfway closing.

2. Description of the Prior Art

U.S. Pat. No. 4,735,447 and U.S. Pat. No. 4,948,183, respectively disclose conventional lock devices for vehicular side doors, which having no auto-closing mechanism. According to the U.S. patents above, a latch and a ratchet are installed at the front side of the vehicular body, a number of manual operation members such as a lock lever and an open lever are installed at the back face of the vehicular body, so as to thin as much as possible the front-and-back thickness of the conventional lock device. The shape of such lock device is given or determined with the size and shape of the space usable to install the lock device in the side door.

SUMMARY OF THE INVENTION

Accordingly, the purpose of the present invention is to provide an auto-closing vehicle door lock device having the basic construction of the conventional lock device and, additionally, an auto-closing mechanism. The auto-closing vehicle door lock device can be applied to almost all kinds of side doors of a motor vehicle, so to be a universal door lock device.

DESCRIPTION OF THE PREFERRED EMBODIMENTS

Figure 1:
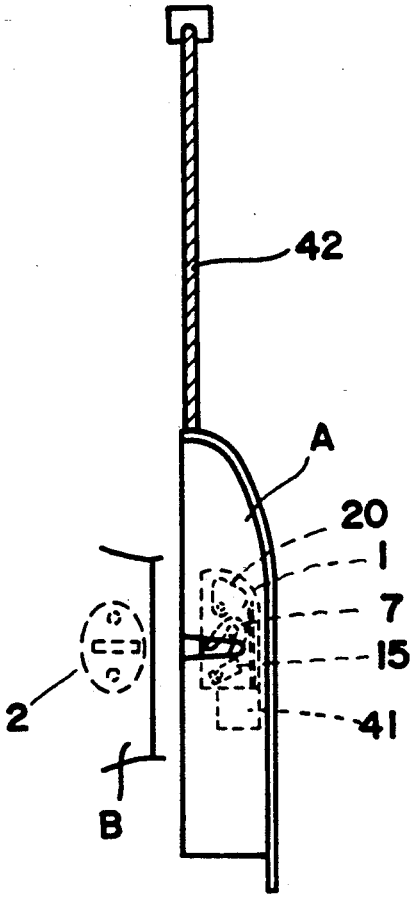
FIG. 1 is a sectional view of the auto-closing vehicle door lock device according to the present invention.
Figure 2:
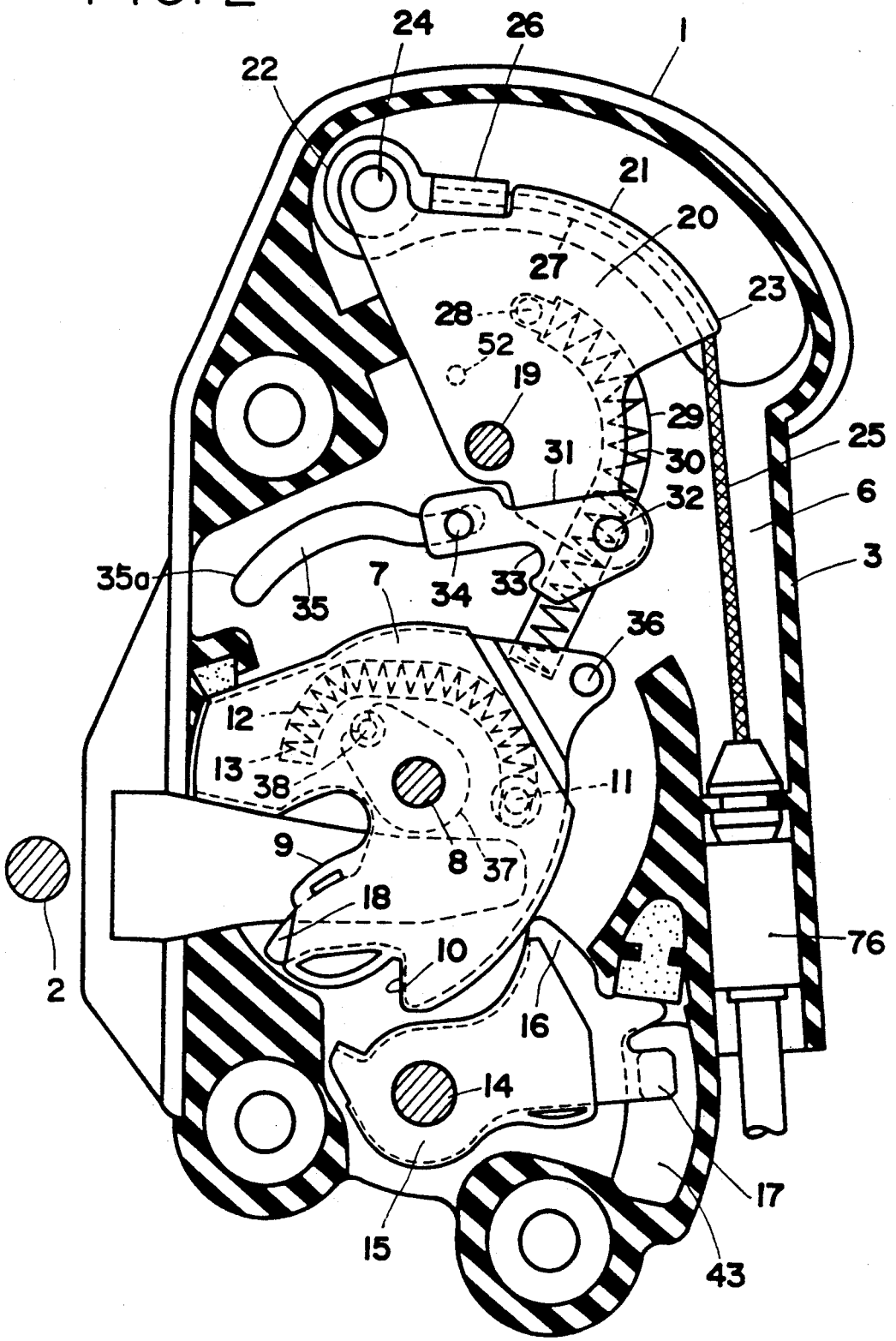
FIG. 2 is a front view of the lock device when it is open.
Figure 3:
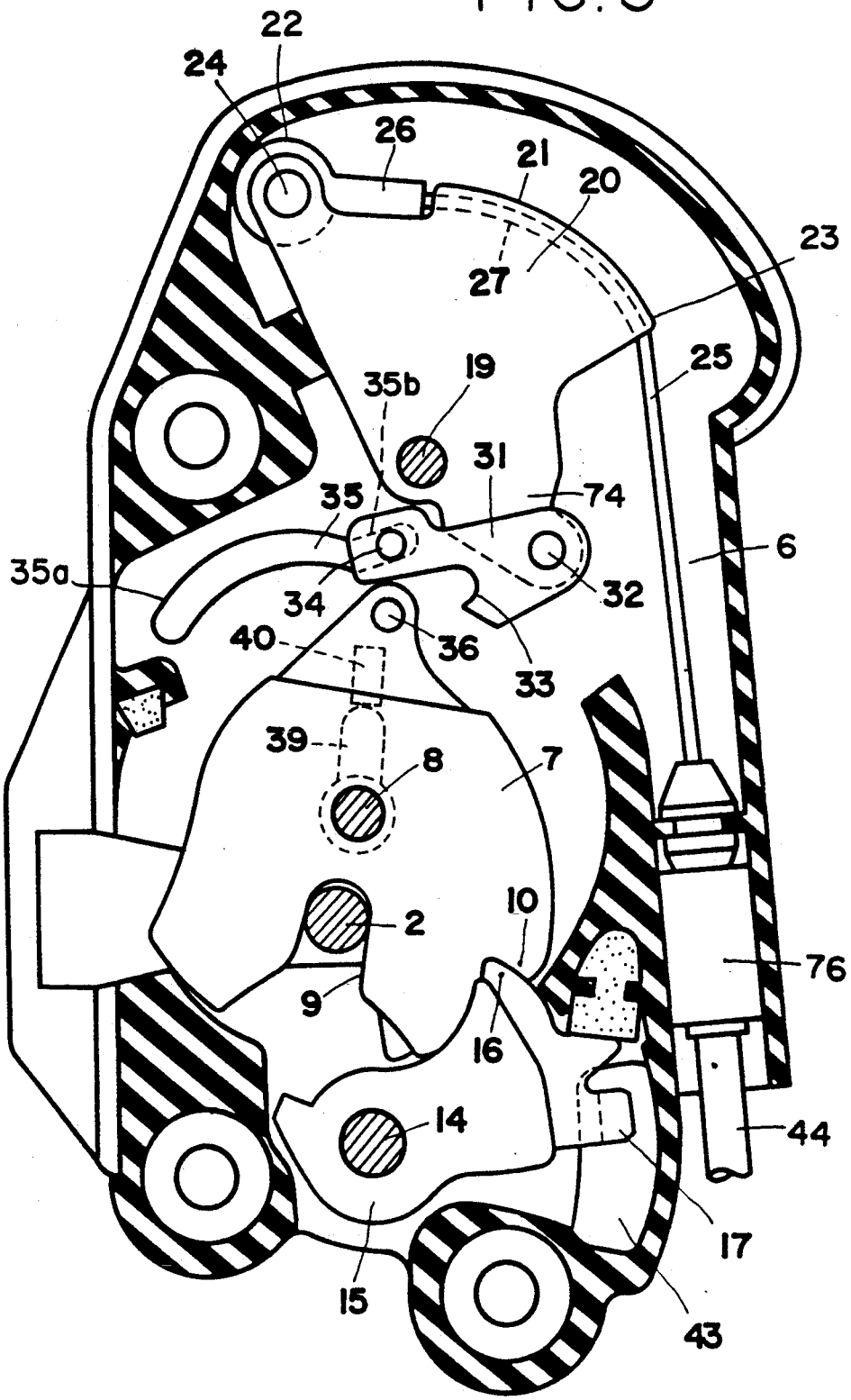
FIG. 3 is a front view of the lock device when it is half latched.
Figure 4:
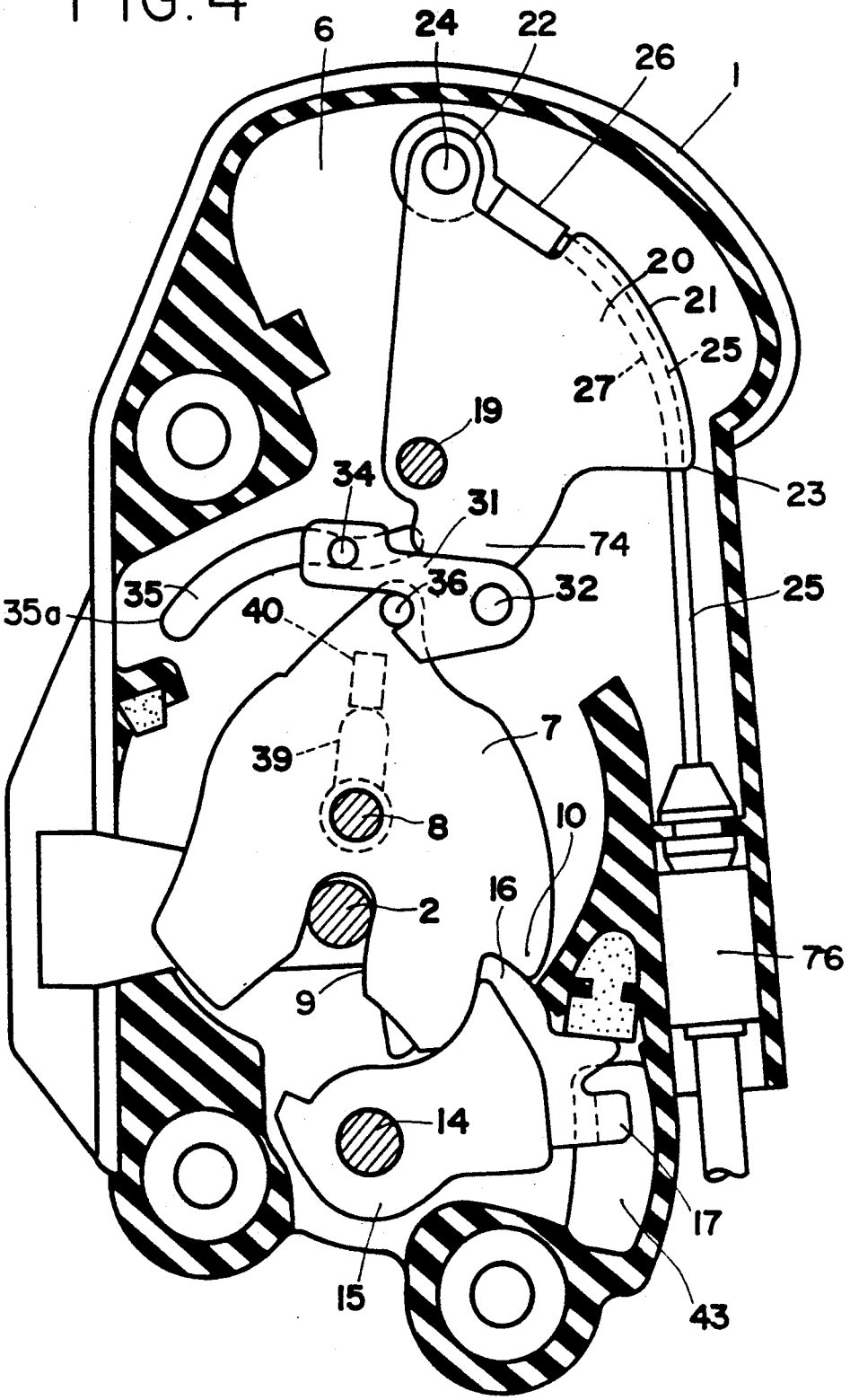
FIG. 4 is a front view of the lock device provided with a fan-shaped lever rotated from its position shown in FIG. 3.
Figure 5:
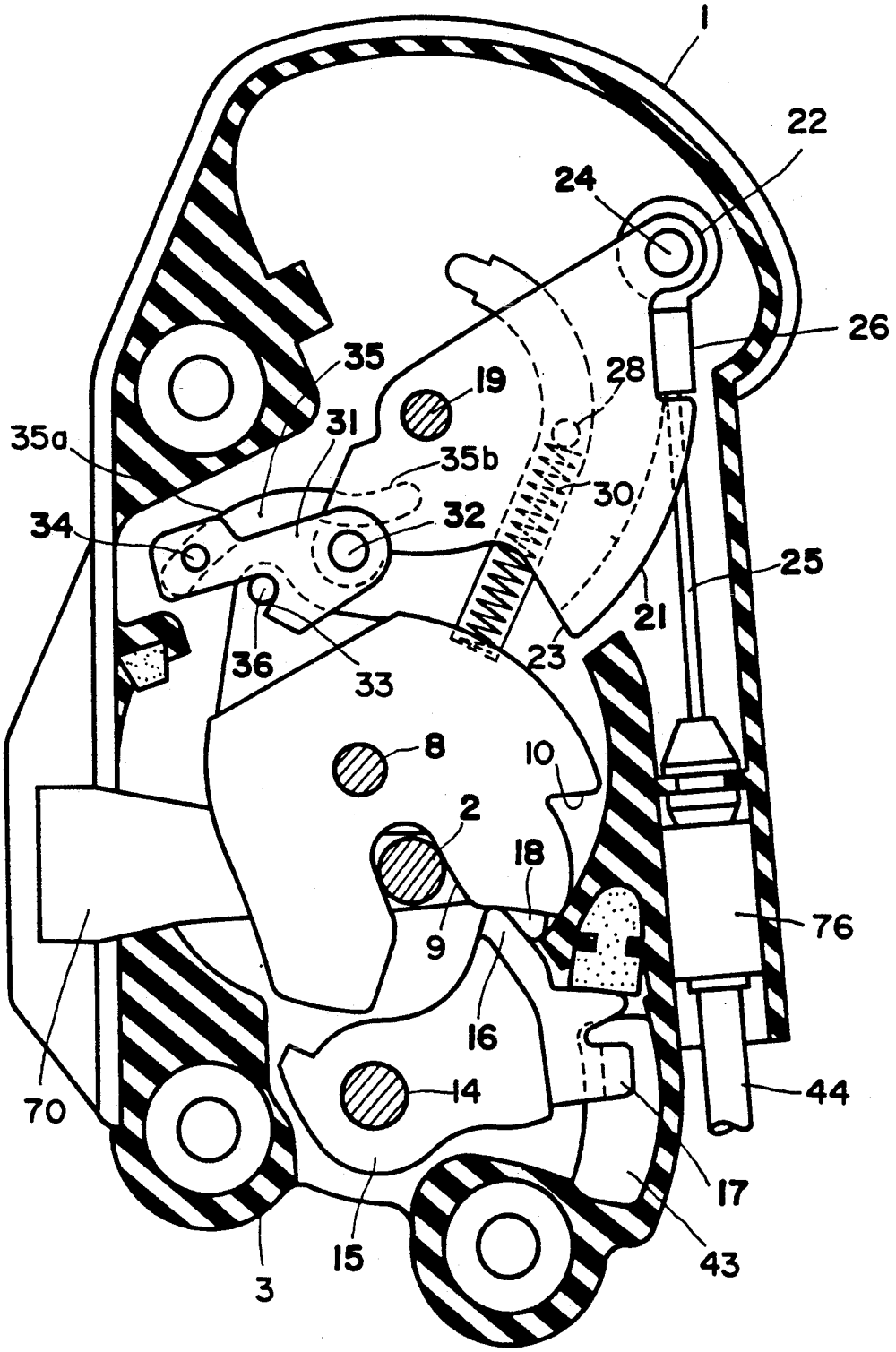
FIG. 5 is a front view of the lock device when it is fully latched.

The auto-closing vehicle door lock assembly of the present invention consists of a lock device 1 adapted to be fixed to the door A and a striker 2 adapted to be secured to the vehicle body B. The lock device 1 has a synthetic resin or plastic-made housing 3. The door A has a window pane 42 arranged on the door as shown in FIG. 1. A dent 6 closed or covered by a metal cover plate 4 is formed on the housing 3 at its front side. The dent 6 has a long shape extending along a up-and-down direction. A latch 7 adapted to engage with the striker 2 is rotatably secured at about the mid portion in a vertical direction of the dent 6 through a shaft 8. When the door A is shut, the striker 2 enters into the guide groove 70 of the housing 3 and engages with an engagement groove 9 of the latch 7, thus the latch 7 rotates. FIG. 2 shows an open position of the latch 7, FIGS. 3 and 4 show its half latched position, and FIG. 5 depicts its fully latched position.

An engagement pin 36 is secured to the latch 7 so as to extend to both the sides of the latch 7 in parallel with the shaft 8. The engagement pin 36 is placed at a position opposite to the engagement groove 9 putting the shaft 8 between them. When the latch 7 rotates to the half latched positions shown in FIGS. 3 and 4, the engagement pin 36 reaches about its top or highest position.

A small projection 11 facing a groove 12 arc-shaped about the shaft 8 formed on the housing 3 is provided on the latch 7 at its back side. The arc-shaped groove 12 contains a coil spring 13 for pressing the small projection 11 and rotating the latch 7 clockwise on FIG. 2.

A ratchet 15 is rotatably fixed to the dent 6 placed below the latch 7 by means of a shaft 14 extending in parallel with the shaft 8. The ratchet 15 is urged to rotate counterclockwise by a spring (not shown). A claw 16 of the ratchet 15 engages with a first stepped portion 10 of the latch 7 when the latch 7 rotates to its half-latched position shown in FIG. 3. When the latch 7 rotates to its full-latched position shown in FIG. 5, the claw 16 of the ratchet 15 engages with a second stepped portion 18 of the latch 7 preventing the latch 7 from reverse-rotating.

On a front end portion of the ratchet 15, a protrusion 17 projecting to a back side of the housing 3 through an oval hall 43 formed in the housing 3 is provided. Some known operative member (not shown) such as the open lever, lock lever and the like is secured to the back side face of the housing 3. The protrusion 17 moves downward as shown in FIG. 2 to FIG. 5 when the door opens by operation of the operative members. As a result, the claw 16 of the ratchet 15 disengages from the stepped portion 10 or 18 of the latch 7 and the latch 7 is made free.

A fan-like lever 20 is rotatably secured to an upper part of the dent 6 by means of the shaft 19 in parallel with the shaft 8. A binding fixture 26 of a wire 25 is secured at one end 22 of an outer peripheral edge 21 of the fan-like lever 20 by means of a shaft 24. As shown in FIG. 2 to FIG. 6, the wire 25 extends around a U-shaped guide groove 27 formed on the outer peripheral edge 21 and further extends through another end 23 of the outer peripheral edge 21. And the wire 25 extends through a passage 75 formed in the housing 3 and a wire cover 44 which is fixed to the housing 3 by means of a clamp 76.

As shown in FIG. 1, an end portion of the wire 25 is connected to a solenoid or motor 41. When the wire 25 is wound by the motor 41, the fan-like lever 20 rotates around the shaft 19 from its waiting position shown in FIG. 2 and 3 to its operation completion position shown in FIG. 5 through its operation start position shown in FIG. 4.

Figure 6:
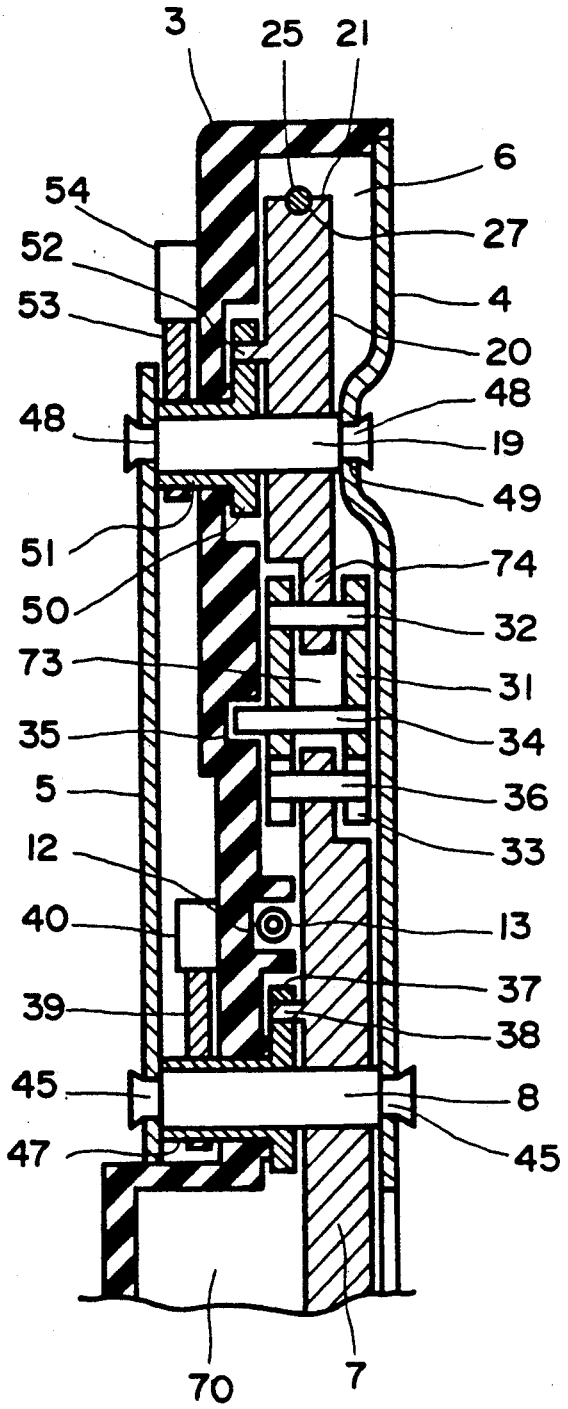
FIG. 6 is a sectional view of a housing of the lock device.
Figure 8:
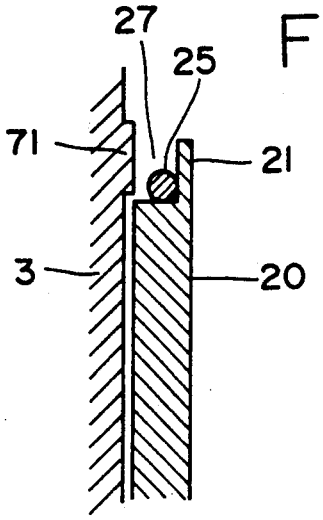
FIG. 8 is a sectional view of another embodiment of a guide groove of the fan-shaped lever.
Figure 9:
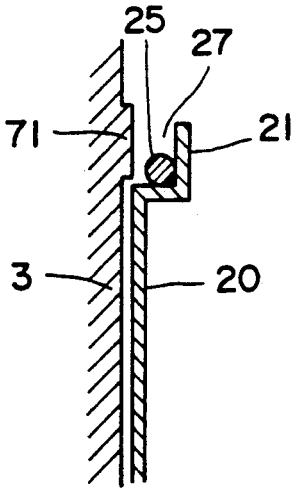
FIG. 9 is a sectional view of still another embodiment of the guide groove.
Figure 10:
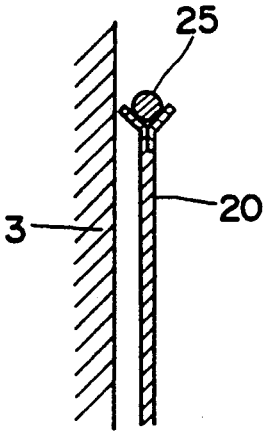
FIG. 10 is a section view of still another embodiment of the guide groove.

The wire guide groove 27 is adapted to prevent the wire 25 from derailing from the outer periphery edge 21 of the fan like lever 20. When a thickness of the fan-like lever 20 is relatively large, the wire guide groove 27 is manufactured in U shape in section as shown in FIG. 6. On the contrary, if the thickness of the fan-like lever 20 is so small that it is impossible to manufacture it in U shape in section, the wire guide groove 27 is formed in L shape with a restriction wall 71 being formed by protruding a part of the wall of the housing 3 facing the wire guide groove as shown in FIGS. 8 and 9. It is possible to form another shape of the wire guide groove 27 of Y shape as shown in FIG. 10.

The fan-like lever 20 has a pin 28 projecting in a groove 29 formed on the housing 3. A spring 30 is contained in the groove 29 curved in its flat shape as shown in FIG. 2. The spring 30 presses the pin 28 in order to urge or rotate the fan-like lever 20 counterclockwise as shown in FIG. 2. When the fan-like lever 20 rotates to its operation completion position shown in FIG. 5 by means of the motor 41, the fan-like lever 20 returns to the waiting position shown in FIG. 2 by resilient force of the spring 30.

Figure 7:
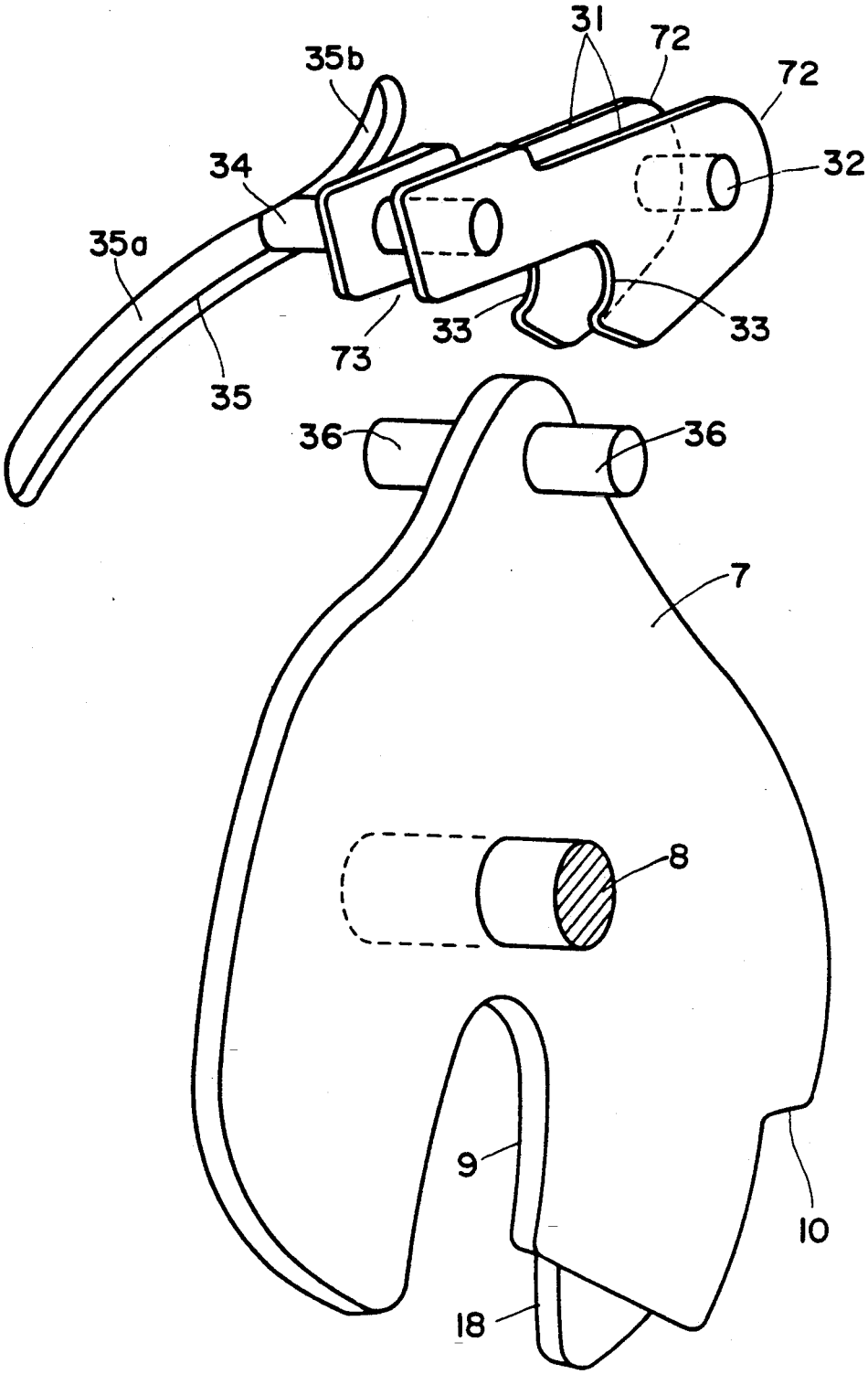
FIG. 7 is an enlarged perspective view of a slide member and a latch member.

A small gap is formed between the fan-like lever 20 and the latch 7 and a slide member 31 is placed within the gap. As shown in FIG. 7, the slide member 31 is formed by overlapping two plates 72 with a gap 73 between them and positioning them by means of a shaft 32 and a guide 34. As shown in FIG. 4 and FIG. 6, the fan-like lever 20 has a fixing part 74 extending toward the latch 7, and the fixing part 74 is inserted between plates 72 which rotatably journalled by means of the shaft 32.

One end of the guide pin 34 of the slide member 31 extends through one of the plates 72 placed at a back side of the housing 3 and enters in the groove 35 formed on the housing 3. The groove 35 consists of an about arc-shaped groove portion 35*a* formed around the shaft 8 and of straight groove portion 35*b* extending from a right end of the arc-shaped groove portion 35*a* toward a right and upper direction. In general, the groove 35 has a long shape extending along about a right and left direction. A hook 33 of the slide member 31 moves when the guide pin 34 moves along the arc-shaped groove portion 35*a*. The track of the moving hook 33 is overlapped with a rotation track of the engagement pin 36 of the latch 7. When the guide pin 34 is positioned at a right side of the straight groove portion 35*b*, the hook 33 is separated from the rotation track of the engagement pin 36 or the hook 33 doesn't engage with the engagement pin 36.

As shown in FIG. 6, the shaft 8 of the latch 7 has two small diameter portions 45 formed at both the ends of the shaft 8. The small diameter portions 45 respectively pass through the cover plate 4 and the back plate 5 and ends of these portions 45 are caulked. A rotation lever 37 is placed on the back side face of the latch 7 and a cylindrical portion 47 of the rotation lever 37 is rotatably supported through the shaft 8. A pin 38 protruding from the latch 7 engages with the rotation lever 37, so that the rotation lever 37 rotates around the shaft 8 as the latch 7 rotates.

The cylindrical portion 47 of the rotation lever 37 extends backward through the housing 3 and a switch arm 39 is secured to the extended end of the cylindrical portion 47. A switch 40 is placed by the switch arm 39 as shown in FIG. 6. The switch 40 is adapted to be pressed by the switch arm 39 when the latch 7 rotates to its half-latched position. The switch 40 is connected to a control circuit of the motor 41. When the switch 40 is pressed by the switch arm 39, electricity is supplied to the motor 41 and the wire 25 is wound.

When the motor 41 rotates the fan-like lever 20 to its operation start position shown in FIG. 4, the slide member 31 is guided by the straight groove 35*b* and the hook 33 of the slide member 31 engages with the engagement pin 36 of the latch 7 positioned at the half-latched position. When the fan-like lever 20 further moves to its operation completion position shown in FIG. 5, the latch 7 compulsorily rotates to the full-latched position through the slide member 31.

The fan-like lever 20 also has a switch 54 for detecting the rotation position of the lever 20. The structure of the switch 54 and parts related to the switch is completely the same as that of the switch 40 and its related part. That is, as shown in FIG. 6, both ends of the shaft 19 respectively has small diameter portions 48 and the small diameter portions 48 pass through the cover plate 4 and the back plate 5 and ends of the portions 48 are caulked. A rotation lever 50 is arranged on the back face of the fan-like lever 20 and a cylindrical portion 51 of the rotation lever 50 is rotatably supported by the shaft 19. A pin 52 projecting from the fan-like lever 20 engages with the rotation lever 50. When the fan-like lever 20 rotates, the rotation lever 50 rotates together with the fan-like lever 20 around the shaft 19.

The cylindrical portion 51 of the rotation lever 50 extends backward through the housing 3 and a switch arm 53 is secured to the extended end of the cylindrical portion 51. A switch 54 is placed about the switch arm 53, which switch 54 is adapted to be pressed by the switch arm 53 when the fan-like lever 20 rotates to its operation completion position shown in FIG. 5. The switch arm 54 is joined to a control circuit of the motor 41. A power source of the motor 41 is turned off when the switch 54 is pressed by the switch arm 53.

Operation of the auto-closing vehicle door lock device of the present invention will be described.

The fan-like lever 20 stops at its waiting position by means of resilient force of the spring 30 as shown in FIG. 2 when the door is open. Then, the latch 7 stops at its open position by resilient force of the spring 13. When the fan-like lever 20 and the latch 7 stop at their positions as mentioned above, and the door A is quietly closed, the striker 2 placed at the vehicle body B engages with the engagement groove 9 of the latch 7 at a side of the door A, rotating the latch 7 to its half-latched position shown in FIG. 3. Consequently, the engagement pin 36 of the latch 7 moves to an advanced position of the moving hooks 33 of the slide member 31. The switch arm 39 secured to the rotation lever 37 adapted to cooperatively move with the latch 7 rotates to its half-latched position, pressing the switch 40.

When the switch arm 39 presses the switch 40, electricity is given to the motor 41 and the motor 41 winds up the wire 25, so that the fan-like lever 20 is compulsorily rotated around the shaft 19. The slide member 31 connected to the fan-like lever 20 by the shaft 32 is guided by engagement of the pin 34 with the straight groove 35*b*. Consequently, the hooks 33 move toward the engagement pin 36 of the latch 7. When the fan-like lever 20 rotates to its operation start position shown in FIG. 4, the hook 33 engages with the engagement pin 36.

When the motor 41 further rotates and the fan-like lever 20 moves to its operation completion position as shown in FIG. 5, the hooks 33 of the slide member 31 are guided by the arc-like groove 35*a* without disengagement from the engagement pin 36 and the latch 7 rotates to its full-latched position shown in FIG. 5.

Finally, the claw 16 of the ratchet 15 engages with the second stepped portion 18 of the latch 7 completing a closing door.

When the fan-like lever 20 moves to its operation completion position, the switch arm 53 secured to the rotation lever 50 adapted to rotate together with the fan-like lever 20 also moves its operation completion position, so that the switch arm 53 presses the switch 54 stopping electricity from flowing to the motor 41. Accordingly, the fan-like lever 20 positioned at the operation completion position returns to the waiting position shown in FIG. 2 because of the resilient force of the spring 30.

Because the slide member 31 has a pair of hooks 33 adapted to engage with the engagement pin 36 projecting from both the front and rear faces of the latch 7, too much force is not given to the latch 7 and the latch 7 smoothly rotates. If the plate 72 of the slide member 31 is manufactured with thin metal plate, the plate 72 will completely stand any strong force.

Because the hook 33 of the slide member 31 is separated from the rotation track of the pin 36 of the latch 7 when the door is open; the latch 7 is placed at its full-latched position shown in FIG. 5 and the fan-like lever 20 is at its waiting position shown in FIG. 2, the pin 36 of the latch 7 can smoothly rotate to its open position because of the resilient force of the spring 13, after making the latch 7 free by opening the door, without being interrupted by the hook 33.

According to the present invention, when the door A is shut with too much energy and the members of the lock device are positioned as shown in FIG. 2, the striker 2 forcibly engages with the engagement groove 9 of the latch 7, so that the latch 7 rotates to the full-latched position shown in FIG. 5. Thus, it is possible to open the vehicle door without using the force of the motor 41. Thus, if the motor 41 malfunctions the vehicle can be driven safely with doors shut.

What is claimed is:

1. A door lock comprising:

a housing having a front face provided with a dent extending along an up-and-down direction, said housing is adapted to be secured to a door, a striker secured to a vehicle body, and a latch rotating from an open position to a full-lock position through a half-latched position, a ratchet for preventing the latch from reversely rotating, a motor being given electricity when said latch rotates to said half-latched position, and a lever rotating by force of the motor and engaging said latch positioned at said half-latched position in order to rotate said latch to said full-latched position, wherein the lever, the latch and the ratchet are arranged in said dent along an up-and-down direction and respectively rotatably secured to the housing by parallel shafts, and the latch is positioned between said lever and said ratchet.

2. The door lock device according to claim 1, wherein said dent is covered by a cover plate.

3. The door lock device according to claim 1, wherein said lever rotates by the motor from a waiting position to an operation completion position through an operation start position and the lever at said waiting position doesn't engage with said latch.

4. The door lock device according to claim 3, wherein electricity being supplied to said motor stops when said lever reaches said operation completion position and the lever has a spring for urging said lever toward said waiting position.

5. The door lock device according to claim 1, wherein said lever has an arc-like outer peripheral edge, an end of a wire is connected to an end of said arc-like outer peripheral edge, and another end of the wire is connected to the motor after being wound around the outer peripheral edge.

6. The door lock device according to claim 5, wherein a guide groove for preventing said wire from derailing is formed on said outer peripheral edge of the lever.

7. The door lock device according to claim 6, wherein said guide groove is of U-shaped or V-shaped in section.

8. The door lock device according to claim 6, wherein said guide groove is of L-shaped in section and said housing has a restraining wall protruded toward the L-shaped groove.

9. A door lock device comprising:

a housing having a front face provided with a dent, said housing is adapted to be secured to the door, a latch rotatably secured in said dent, adapted to engage with a striker secured to a vehicle body, and adapted to rotate from an open position to a full-lock position through a half-latched position, a ratchet rotatably secured in the dent so as to prevent the latch from reverse-rotating, a motor adapted to be given electricity when the latch rotates to said half-latched position, a lever adapted to be rotatably secured in the dent so as to rotate by force of said motor, a hook positioned between said lever and said latch and rotatably secured to the housing, wherein the hook engages with the latch at said half-latched position when the motor functions so as to rotate the latch to said full-latched position.

10. The door lock device according to claim 9, wherein a pair of engagement pins projecting from both the sides of the latch is secured to the latch, said hook has a pair of plates overlapped leaving a gap through which a part of said latch is inserted, and said plates have hooks respectively engaging with the engagement pins of said latch.

11. The door lock device according to claim 9, wherein said housing has a guide groove guiding the movement of said hook, and said guide groove extends along a right-and-left direction.

12. The door lock device according to claim 11, wherein said lever has a structure which is rotated by said motor from said waiting position to said operation completion position through said operation start position, the guide groove has a straight groove for guiding said movement of said hook while the hook moves from said waiting position and said operation start position and an arc-like groove around the rotating shaft of the latch for guiding said movement of said hook while the hook moves from said operation start position to said operation complete position, and said hook doesn't engage with the latch when it is at said waiting position.

13. The door lock device according to claim 12, wherein electricity supplied to the motor stops when the lever reaches said operation completion position, and the lever has a spring mounted therein so as to urge said lever toward said waiting position.

* * * * *